US006557650B2

(12) United States Patent
Fayard et al.

(10) Patent No.: US 6,557,650 B2
(45) Date of Patent: May 6, 2003

(54) METHOD AND APPARATUS FOR PROTECTING EXPLOSIVES

(75) Inventors: Alfredo Fayard, Sugar Land, TX (US); Wenbo Yang, Sugar Land, TX (US); Anthony F. Veneruso, Missouri City, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 10/007,726

(22) Filed: Nov. 13, 2001

(65) Prior Publication Data

US 2003/0056982 A1 Mar. 27, 2003

Related U.S. Application Data

(63) Continuation-in-part of application No. 09/596,612, filed on Jun. 19, 2000.

(51) Int. Cl.[7] ..... E21B 29/02; E21B 43/11; E21B 43/117; F42B 3/02; C06B 45/06

(52) U.S. Cl. ..... 175/4.59; 175/4.6; 166/63; 166/297; 89/1.15; 102/318; 149/108.8

(58) Field of Search ..... 89/1.15; 102/307, 102/313, 314, 318, 476; 149/109.4, 108.8; 166/55, 63, 297; 175/4.5, 4.57, 4.59, 4.6

(56) References Cited

U.S. PATENT DOCUMENTS 4,061,511 A 12/1977 Baczuk
4,191,265 A 3/1980 Bosse-Platiere
4,352,396 A 10/1982 Norwood
4,636,934 A 1/1987 Schwendemann et al.
4,649,822 A 3/1987 Seeman
5,859,383 A 1/1999 Davison et al.
6,021,714 A 2/2000 Grove et al.

FOREIGN PATENT DOCUMENTS

GB 1187661 A * 4/1970 ..... F42D/7/00

OTHER PUBLICATIONS

Lewis, Sr., Richard J., Hawley's Condensed Chemical Dictionary, Van Nostrand Reinhold Company, 12th Edition, p. 791.

* cited by examiner

*Primary Examiner*—David Bagnell
*Assistant Examiner*—Jennifer H Gay
(74) *Attorney, Agent, or Firm*—Trop, Pruner & Hu P.C; Jeffrey E. Griffin; Brigitte Jeffery

(57) ABSTRACT

A method and apparatus to protect explosive components used in various tools, such as tools for use in wellbores, includes a component with an adsorptive material. Example tools include perforating gun strings that include shaped charges, detonating cords, and booster explosives. Other tools may include surface tools containing explosive components. The adsorptive material is placed inside a container. A temperature-activated mechanism is used to open the container. The temperature-activated mechanism includes an element formed of a shape memory metal or plural layers with different coefficients of thermal expansion, such as a bi-metallic strip.

52 Claims, 10 Drawing Sheets

METHOD AND APPARATUS FOR PROTECTING EXPLOSIVES

CROSS REFERENCE TO RELATED APPLICATION

This is a continuation-in-part of U.S. Ser. No. 09/596,612, filed Jun. 19, 2000.

TECHNICAL FIELD

The invention relates to protecting explosives, such as explosives used in downhole environments.

BACKGROUND

One operation that is performed in completing a well is the creation of perforations in a formation. This is typically done by lowering a perforating gun string to a desired depth in a wellbore and activating the gun string to fire shaped charges. The shaped charges when fired create perforating jets that form holes in surrounding casing as well as extend perforations into the surrounding formation.

Various types of perforating guns exist. One type of perforating gun includes capsule shaped charges that are mounted on a strip in various patterns. The capsule shaped charges are protected by individual containers or capsules from the harsh wellbore environment. Another type of perforating gun includes non-capsule shaped charges, which are loaded into a sealed carrier for protection. Such perforating guns are sometimes also referred to as hollow carrier guns. The non-capsule shaped charges of such hollow carrier guns may be mounted in a loading tube that is contained inside the carrier, with each shaped charge connected to a detonating cord. When activated, a detonation wave is initiated in the detonating cord to fire the shaped charges. In a hollow-carrier gun, charges shoot through the carrier into the surrounding casing formation.

The reliability of wellbore perforating guns depends on the mechanical properties and performance of many precise components and materials that are exposed to hostile conditions (e.g., high temperatures, mechanical shock and vibration, and so forth). Explosive components may also be degraded by water or vapor and other corrosive gases or liquids that are generated within the guns themselves. Typical explosive components in a perforating gun includes shaped charges and detonating cords. As shown in FIG. 1, a shaped charge 10 typically includes a main explosive charge 16 and a metallic liner 20, both contained in an outer case 12. A primer charge 14 coupled to the back of the main explosive charge 16 is ballistically connected to a detonating cord 24. A detonation wave traveling down the detonating cord 24 transfers energy to the primer charge 14, which in turn initiates the main explosive 16. Detonation of the main explosive 16 causes the liner 20 to collapse to form a perforating jet.

The following are examples of damage that may be caused to explosive components in a corrosive environment, which may contain water vapor and other gases. The outer jacket of the detonating cord may be damaged, which may increase the likelihood that the detonating cord may break resulting in the guns not firing. Damage to the outer jacket of a detonating cord may also be a safety hazard. The detonating cord may be accidentally pinched which may cause it to initiate.

The corrosive environment also desensitizes explosive materials in the detonating cords, shaped charges, or other components, which may cause a perforating gun to not fire.

When a perforating gun string is lowered to a desired depth but for some reason cannot be activated, a mis-run has occurred. This requires that the perforating gun string be pulled out of the wellbore and replaced with a new gun string, which is time consuming and expensive. Also, retrieving a mis-fired gun from a wellbore may be a hazardous operation.

In addition, an explosive has a certain range of time and temperature in which the explosive is thermally stable. If the explosive is stretched beyond this range, the explosive starts to decompose, burn, or auto-detonate. The presence of water vapor acts as a catalyst that further accelerates the rate of decomposition of the explosive. Other products of decomposition may also act as catalysts in accelerating the decomposition.

A need thus exists for a method and apparatus to protect explosives in a corrosive environment and to reduce effects of explosive decomposition which may occur downhole or at the surface.

SUMMARY

In general, according to one embodiment, an apparatus includes a housing, an explosive in the housing, and a material placed in the housing and in the proximity of the explosive to remove corrosive fluid to protect the explosive.

Other or alternative features will become apparent from the following description, from the drawings, and from the claims.

BRIEF DESCRIPTION OF THE DRAWINGS

FIGS. 11B–11C are top views of one embodiment of the temperature-activated opening mechanism that includes shape memory metal strips.

DETAILED DESCRIPTION

In the following description, numerous details are set forth to provide an understanding of the present invention.

However, it will be understood by those skilled in the art that the present invention may be practiced without these details and that numerous variations or modifications from the described embodiments may be possible.

As used here, the terms "up" and "down"; "upper" and "lower"; "upwardly" and "downwardly"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
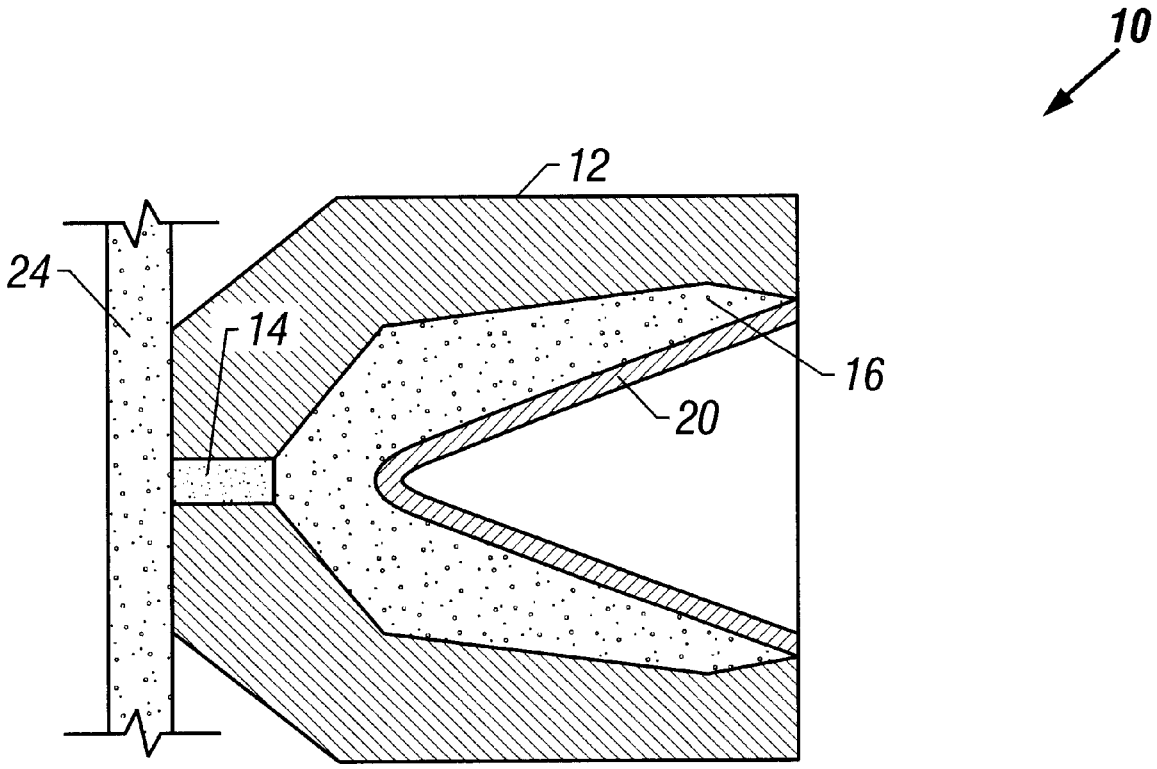
FIG. 1 (Prior Art)
FIG. 1 illustrates a conventional shaped charge.
Figure 2:
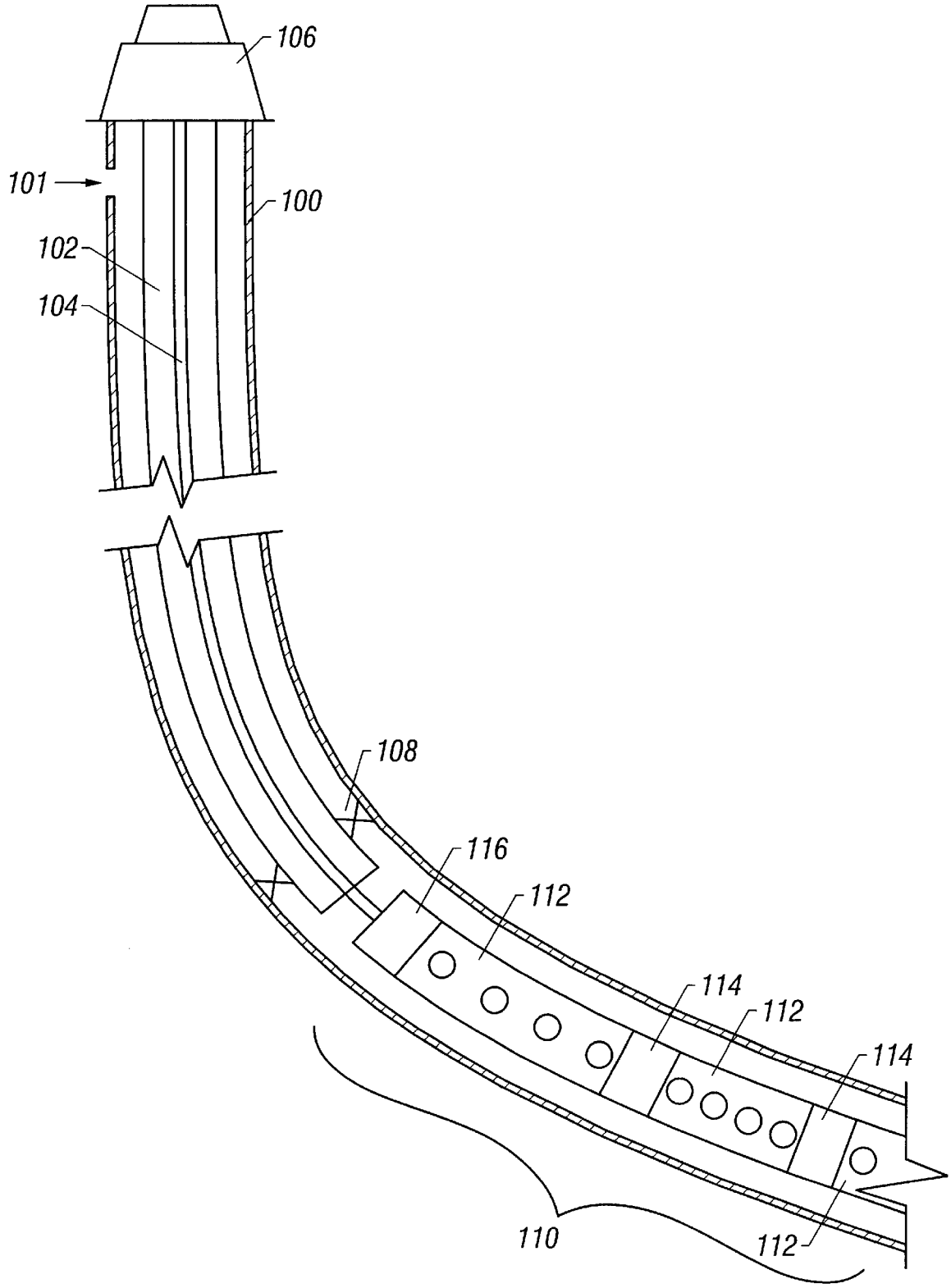
FIG. 2 illustrates an embodiment of a completion string having a perforating gun string with plural guns coupled by adapters.

Referring to FIG. 2, an example completion string in a wellbore 101 is illustrated. The wellbore 101 may be lined with casing 100, and a production tubing 102 may be positioned inside the casing 100 to provide a conduit for well fluids to wellhead equipment 106. A packer 108 isolates an annular region between the production tubing 102 and the casing 100. A perforating gun string 110, which may be attached to a carrier 104 (e.g., wireline, slickline, or coiled tubing) may be lowered through the tubing 102 to a target depth in the wellbore 101.

To achieve a desired length, the perforating gun string 110 may include multiple guns 112. An example length of each gun 112 may be about 20 feet. To make a perforating gun string of a few hundred feet or longer, several guns are connected together by adapters 114. Each of the adapters 114 contains a ballistic transfer component, which may be in the form of donor and receptor booster explosives. Ballistic transfer takes place from one gun to another as the detonation wave jumps from the donor to the receptor booster. At the end of the receptor booster is a detonating cord that carries the wave and sets off the shaped charges in the next gun 112.

Figure 3:
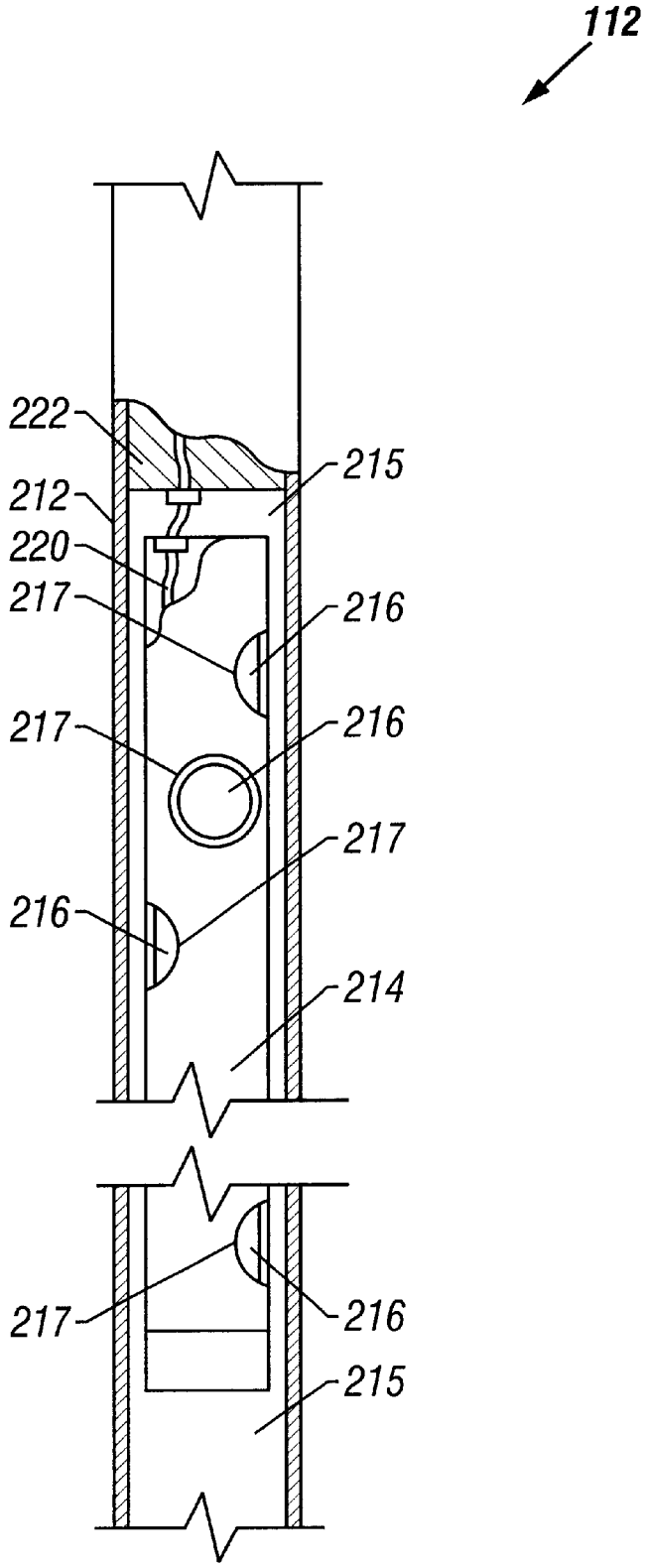
FIG. 3 illustrates a hollow carrier gun useable in the perforating gun string of FIG. 2.

Referring to FIG. 3, each gun 112 may be a hollow carrier perforating gun that includes a carrier 212 that has an inner chamber 215 to contain a loading tube 214, which provides a housing for explosive components of the perforating gun 112. The carrier 212 is sealed to protect components inside the carrier from the wellbore environment. The loading tube 214 includes a number of openings 217 proximal, which shaped charges 216 may be mounted. In the illustrated embodiment, the loading tube 214 includes shaped charges 216 arranged in a spiral arrangement to perforate in a plurality of directions. In alternative embodiments, other phasing patterns may be used.

A detonating cord 220 extends through an upper bulkhead 222 of the gun carrier 212 and an upper portion of a carrier chamber 215 to the loading tube 214. The detonating cord 220 is passed into the loading tube 214 for connection to the shaped charges 216. Examples of explosives that may be used in the various explosive components (e.g., shaped charges 216, detonating cord 220, and boosters) include RDX, HMX, HNS, TATB, and others.

The presence of corrosive gases (including water vapor or other gases) or other corrosive fluids in each perforating gun 112 or adapter 114 has been found to cause problems, especially at high temperatures (e.g., above about 100° C.). Moisture trapped in the carrier 212 (such as during assembly) or adapter 114 creates water vapor. In addition, pollutants may also be trapped during assembly and other corrosive gases may be emitted by various components in the perforating gun, including explosive components. Water vapor together with the other gases may create a corrosive environment within the gun 112 or adapter 114. A corrosive environment may cause certain components to warp, become brittle, or lose strength. For example, the corrosive environment may damage the outer protective jacket of the detonating cord 220, which may cause the detonating cord 220 to break or mis-fire and prevent firing of the gun 112. Also, if the outer jacket of the detonating cord 220 is damaged, a safety hazard is created since the detonating cord 220 may be pinched to set it off.

Furthermore, explosives have certain ranges of time and temperature in which they are thermally stable. If they are stretched beyond this time and temperature range, explosives may start to decompose, burn, or auto-detonate. Decomposition of the explosives creates products (referred to as out-gassing), which may include corrosive gases. Presence of water vapor and other gases acts as a catalyst in accelerating the decomposition of the explosive. Due to decomposition, the reliability, performance, and stability of explosive components may become compromised.

As used here, the term "corrosive gas" refers to any form of gas that may cause damage to or reduce the structural integrity, chemical integrity or stability, or other characteristic of an explosive component. The term "corrosive fluid" refers to any gas or liquid that may do the same.

In accordance with some embodiments of the invention, materials may be placed proximal explosives in tools to remove corrosive fluids to protect the explosives. Removal refers to adsorption, trapping, reaction, and any other interactions with the corrosive fluids to reduce their effect on the explosives, even at elevated temperatures. As used here, "explosives" may also refer to propellants used in various applications. The protective materials may react with corrosive fluids to lessen their adverse effect on explosives. The protective materials may also prevent or reduce the reaction of corrosive fluids with explosives so that the explosives maintain their integrity despite presence of corrosive fluids.

In one embodiment, components having adsorptive materials may be placed inside the perforating gun 112 or adapter 114 (or any other tool containing explosive components) to adsorb water vapor and other corrosive gases that may be present. The adsorptive materials may also be capable adsorbing liquids in addition to gases. In the ensuing discussion, protection of explosives is performed using adsorptive materials; however, in further embodiments, other forms of protective materials as discussed above may be employed.

The adsorptive materials are effective at relatively high temperatures (e.g., greater than about 140° F.). Some adsorptive materials are capable of effective performance at even higher temperatures, such as greater than 200° F. up to 600° F. or even higher. Zeolite (discussed below) is one example of an adsorptive material that is effective at high temperatures. In contrast, typical desiccants used in surface applications are usually effective at or near room temperature but become ineffective if the temperature is raised. Also, typical surface desiccants are designed to adsorb water vapor.

Adsorption refers to adhesion or trapping of gases, solutes, or liquids in solid bodies or liquids. By using components having an adsorptive agent, corrosive gases or liquids may be adsorbed, thereby reducing the amount of such gases so that likelihood of damage to explosive components in the gun 112 and adapter 114 is decreased. Examples of adsorptive agents include alumina, activated charcoal, calcium-aluminosilicate, montmorillonite clay porcelain, silica gel, the family of molecular sieves based on organosilicates or organoaluminosilicates, or metalsilicate molecular sieves such as aluminophosphates. The adsorptive material selected may be based on the target gases or liquids that are to be adsorbed. Some materials are better able to adsorb certain gases or liquids than other materials. The pore sizes and chemical structures of the different adsorptive materials are varied to target different gases or liquids.

In one embodiment, the adsorptive material selected may include a type of molecular sieve containing a high-temperature desiccant called zeolite. Zeolite is made of sodium aluminosilicate, and has the ability to adsorb water molecules as well as other types of molecules with larger diameters such as aromatic branched-chain hydrocarbons. One formula for zeolite is $Na_{86}[(AlO_2)_{86}(SiO_2)_{106}]x\ H_2O$. The nominal pore size for zeolite is approximately 10 Angstroms. The pores in the zeolite trap molecules having smaller diameters. Zeolite is available in powder, pellet, or bead form. A component including zeolite may be referred to as a "desiccant module"; however, in further embodiments, other modules or components including other types of adsorptive materials (or combinations of adsorptive materials) may be employed.

The adsorptive material is designed to remove a substantial amount of corrosive fluid form a given environment, such as within a housing or container. A "substantial" amount refers to an amount removed that is effective in protecting an explosive from damage or extending the effective life of the explosive.

Figure 4:
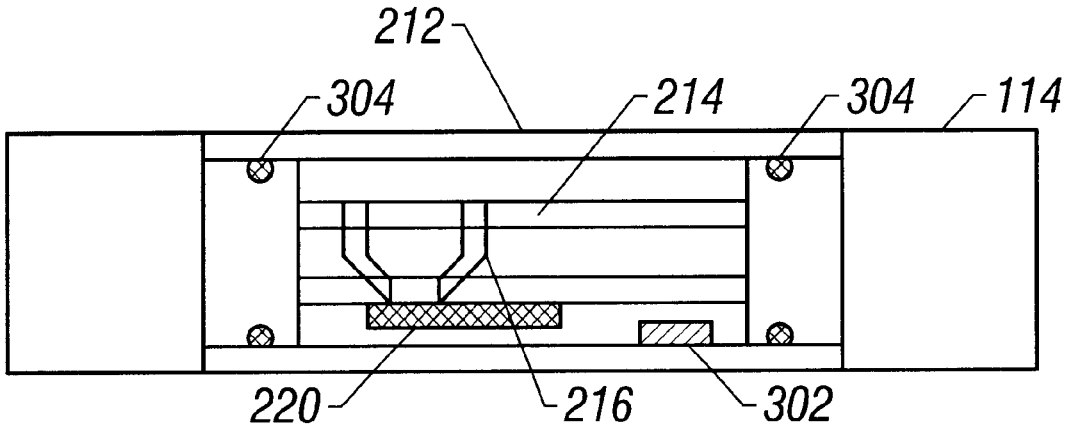
FIG. 4 illustrates components inside the hollow carrier gun including a module containing an adsorptive material in accordance with one embodiment.

Referring to FIG. 4, one or more desiccant modules 302, which may be in the form of a bag, a box, or other configuration, are placed inside the hollow carrier 212. The desiccant module 302 may be placed inside the carrier 212 proximal explosive components in the gun 114, which includes the shaped charges 216 and the detonating cord 220. As shown in FIG. 4, O-ring seals 304 may be provided to hermetically seal the explosive components inside the hollow carrier 212. The one or more desiccant modules 302 reduce the amount of corrosive gases that can build up in the hollow carrier 212.

Figure 5:
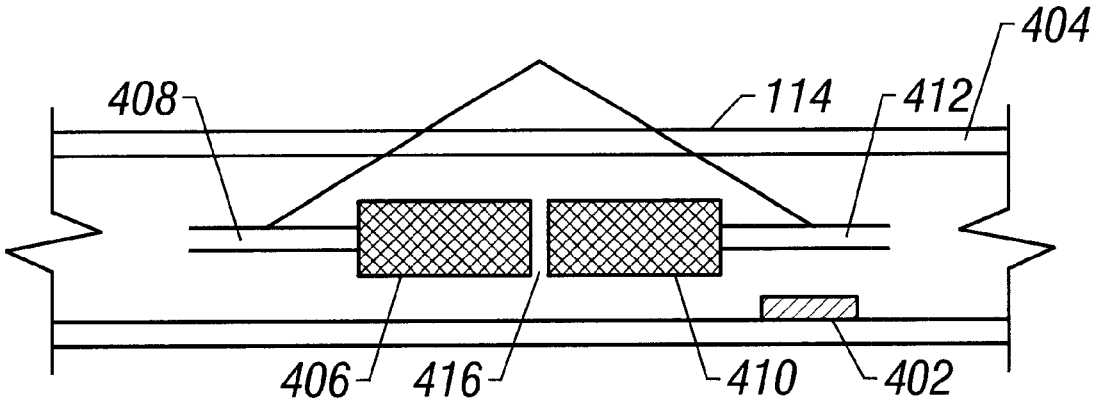
FIG. 5 illustrates components inside an adapter including a module containing an adsorptive material in accordance with an embodiment.

Referring to FIG. 5, one or more desiccant modules are 402 are placed inside a housing 404 of an adapter 114. The adapter may include a donor booster explosive 406 and a receptor booster explosive 410. The donor booster explosive 406 is ballistically coupled to a first detonating cord 408, while the receptor booster explosive 410 is ballistically coupled to a second detonating cord 412. A detonation wave traveling down the first detonating cord 408 is transferred to the donor booster 406, which initiates to transfer the detonation across a gap 416 to the receptor booster explosive 410. Initiation of the receptor booster explosive 410 causes initiation of the detonating cord 412. The adapter housing 404 may be similarly sealed as the gun carrier 212. To prevent buildup of corrosive gases or liquids inside the adapter housing 404, one or more desiccant modules 402 may be placed in the adapter housing 404.

In either the gun carrier 212 or the adapter housing 404, corresponding desiccant modules 302, 402 may be placed in the "proximity" of explosive components. As used here, the term "proximity" or "proximal" refers to a distance of a desiccant module (or other component including an adsorptive material) with respect to an explosive component the desiccant module is intended to protect that allows the desiccant to remain effective. Thus, as shown in FIG. 4, the desiccant module 302 may be placed at one end of the hollow carrier 212 although it may provide effective protection for a shaped charge and a portion of the detonating cord that is at the other end of the hollow carrier 212. Thus, the desiccant module 302 is "proximal" or "in the proximity of" the explosive component if the desiccant module is able to perform its intended task of adsorbing corrosive gases or liquids to protect the explosive component.

Figure 8:
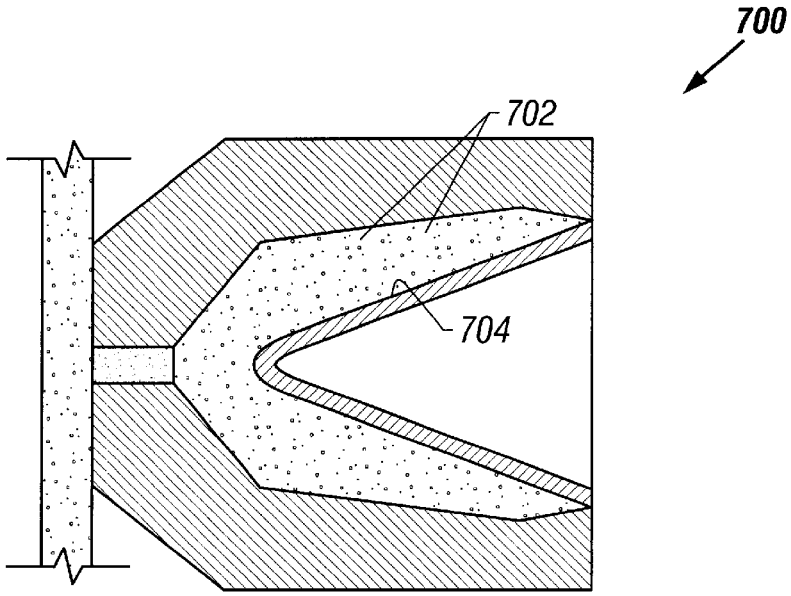
FIGS. 8 and 9 illustrate other embodiments of explosive components having adsorptive material.
Figure 9:
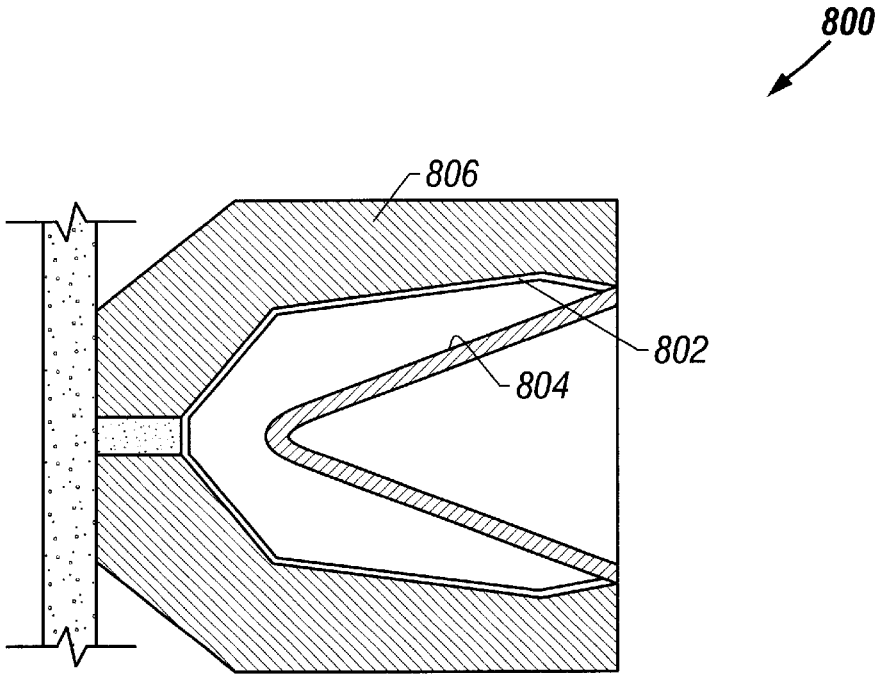

Instead of using modules containing the adsorptive material, other embodiments may have the adsorptive materials mixed with the explosive, such as in a shaped charge 700 shown in FIG. 8. The adsorptive material 702, which may be in powder or pellet form, is mixed with the explosive 704. In another embodiment, a layer 802 of adsorptive material in a shaped charge 800 may be placed between the explosive 804 and a container 806. In other embodiments, a layer of the adsorptive material may be formed on the inner surface of a housing or container in which an explosive is placed. Also, the explosive may be melted with the adsorptive material.

Figure 6:
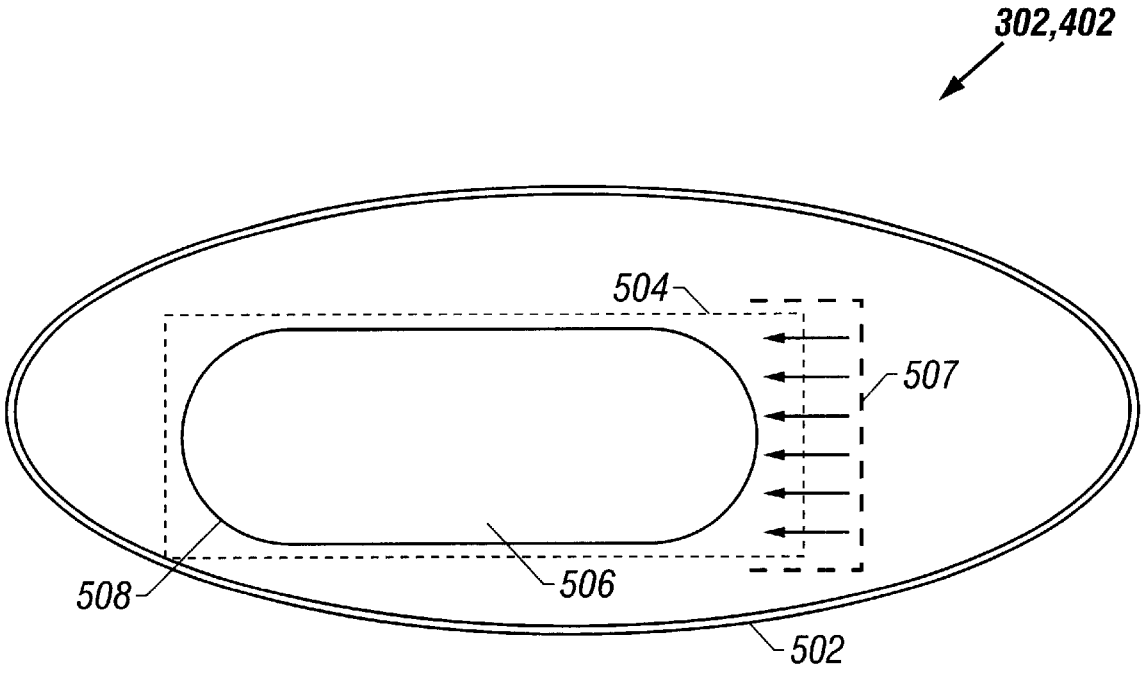
FIG. 6 illustrates a module containing an adsorptive material in accordance with an embodiment usable in the hollow carrier gun or adapter of FIG. 4 or FIG. 5.

Referring to FIG. 6, one embodiment of the desiccant module 302, 402 is illustrated. The desiccant module includes a pouch 502 in which is placed a container 504 that contains a chemically adsorptive agent 506, which may be in pellet, powder or bead form. The adsorptive agent 506, in pellet, powder, or bead form, may be wrapped by a wrapper or cover 508. The wrapper or cover 508 may be made of Teflon, for example. A cap 507 fits over an opening of the container 504.

To protect the container 504 and adsorptive agent 506 during shipment and storage, the container 504 may be sealed within the outer pouch 502. The outer pouch 502 may be made of an aluminized or other metalized plastic film. The film may be made of a thermoplastic material, such as aluminized polypropylene, polyethylene, and others. The film protects the adsorptive material 506 against premature exposure to the atmosphere because a thin layer of metal is effectively impervious to gases.

The body of the module 504 may be made of a metal screen or mesh, such as a metal screen or mesh found in a colander or tea strainer. The body may also be made of a high-temperature porous plastic or a rigid plastic such as PEEK polyetheretherketone (from Victrex Plc) or RYTON® polyphenylene sulfide (from Phillips Petroleum Company) with holes formed in the material. Any other type of container may be used which includes one or more openings.

During installation into the gun system, the outer pouch 502 is opened and the container 504 removed for placement inside the gun system (hollow carrier or adapter). Installation time is not critical because of the presence of the wrapper 508. As the gun assembly is screwed shut, the push-in cap 507 with a sharp set of points may pierce the wrapper 508 to expose the desiccant agent 506. Alternatively, the cover or wrapper 508 may be peeled away to expose the desiccant agent. Also, the cover or wrapper 508 may melt or evaporate at a predetermined temperature.

In other embodiments, other techniques for opening an outer pouch can be used. For example, a temperature-activated mechanism can be used. The temperature-activated mechanism maintains the outer pouch closed at surface temperatures. However, at elevated temperatures such as at downhole temperatures, the temperature-activated mechanism causes the outer pouch to open. Alternatively, a heating element can be placed in the proximity of the temperature-activated opening mechanism. The heating element is turned on to actuate the temperature-activated opening mechanism.

Figure 11A:
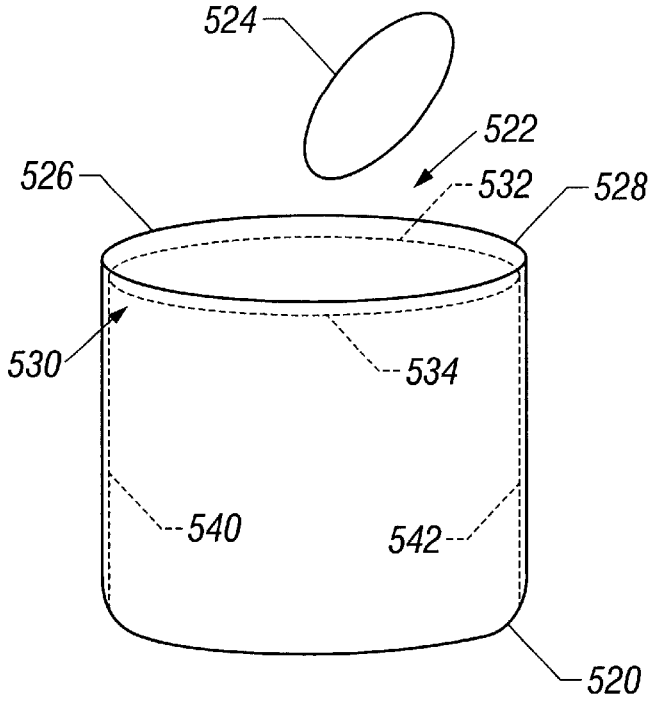
FIGS. 11A–11B illustrate a pouch for containing a desiccant module, the pouch having a temperature-activated opening mechanism.
Figure 11B:
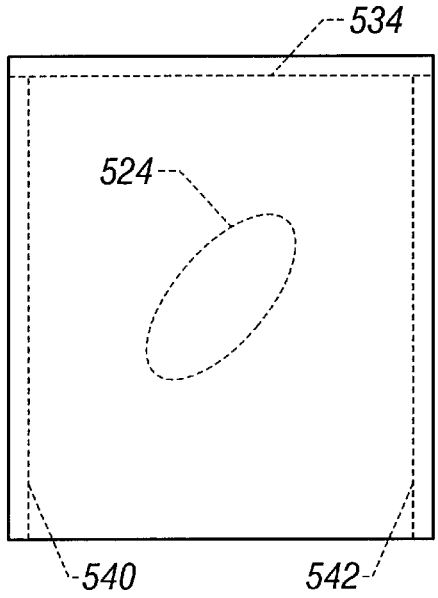

An outer pouch 520 that is open is shown in FIG. 11A. The pouch 520 has an open first end 522 through which a desiccant module (or multiple desiccant modules) 524 can be inserted. After the desiccant module 522 is placed in the pouch 520, the two edges 526 and 528 at the upper end of the pouch 520 are contacted to each other to close the pouch 520. Various types of sealing mechanisms can be used, such as a tongue and groove arrangement. Alternatively, the two edges 526 and 528 can be heated to enable the two edges to be bonded to form a hermetic seal.

A temperature-activated mechanism 530 including elements formed of a shape memory metal can be enclosed in the side walls of the pouch 520. The temperature-activated mechanism 530 includes a first shape memory alloy strip 532 in a first side of the pouch 520, and a second shape memory alloy strip 534 in a second side of the pouch 520. In some embodiments, the shape memory metal strips 532 and 534 are formed of Nitinol, which is an alloy of nickel and titanium. When a shape memory alloy is cold (that is, less than the transformation temperature or austenitic/martensitic transition temperature), the shape memory alloy has a relatively low yield strength and can be deformed relatively easily. However, when the alloy is heated above its transformation threshold, the alloy undergoes a change in crystal structure that causes it to return to its original shape.

Figure 11C:
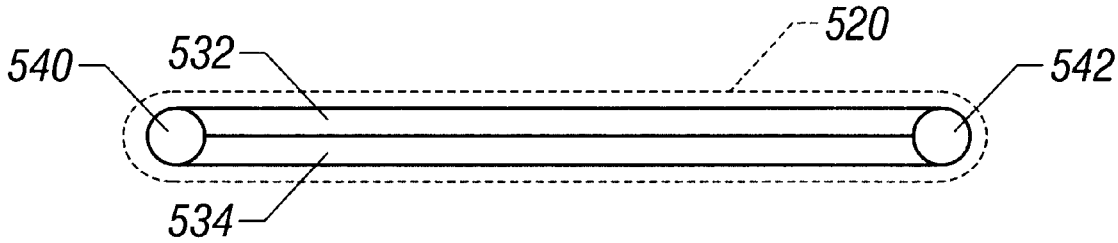

As shown in FIG. 11C at a temperature below a threshold (e.g., 150° C.–100° C.), the shape memory metal strips 532 and 534 are relatively flat so that the pouch edges 526 and 528 can be maintained in a seal arrangement. The two ends of the shape memory metal strips 532 and 534 are attached to support rods 540 and 542.

Figure 11D:
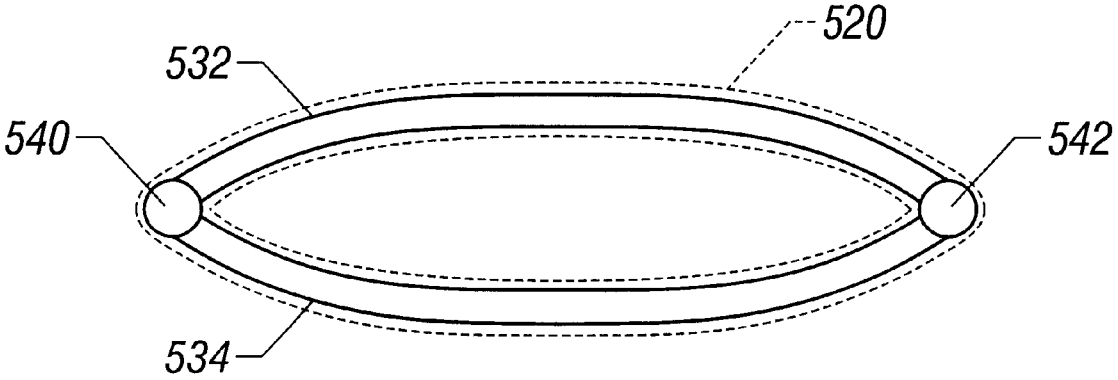

When the pouch 520 including the shape memory metal is lowered into the wellbore and the memory metal strips are heated above the transformation temperature, the shape memory metal strips deform outwardly (as shown in FIG. 11D) to separate the edges 526, 528 of the pouch 520. The shapes shown in FIG. 11D correspond to the original shapes of the strips 532, 534. The shape memory metal strips 532, 534 are able to provide sufficient force to separate the edges 526, 528. In one example arrangement, the increased temperature is provided by the ambient downhole temperature, which can rise to above the transformation temperature of the strips. However, in an alternate arrangement, the increase in temperature is provided by a heating element (not shown). The heating element can be an electrical heater or some other type of heater.

By using the temperature-activated opening mechanism 530, the desiccant module 524 is hermetically sealed from the environment until after the apparatus containing the desiccant module 524 has been lowered into the wellbore and the shape memory metal strips have been heated and deformed to open the pouch 520. Thus, generally, the temperature-activated mechanism has an element that deforms in response to a rise in temperature to open the pouch 520. In the illustrated embodiment, the strips 532, 534 deform by bending away from each other.

Figure 12A:
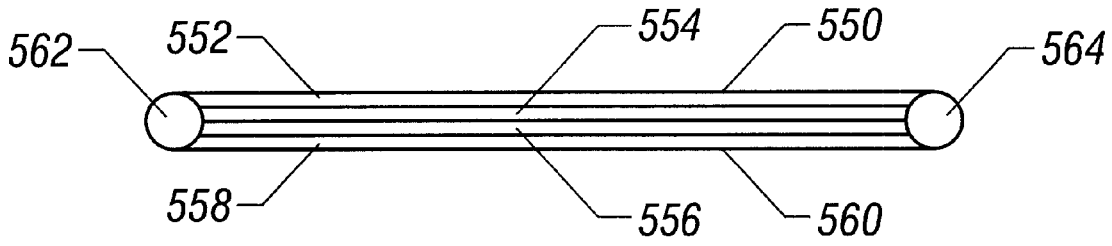
FIGS. 12A–12B are top views of another embodiment of the temperature-activated opening mechanism that includes bi-metallic strips.
Figure 12B:
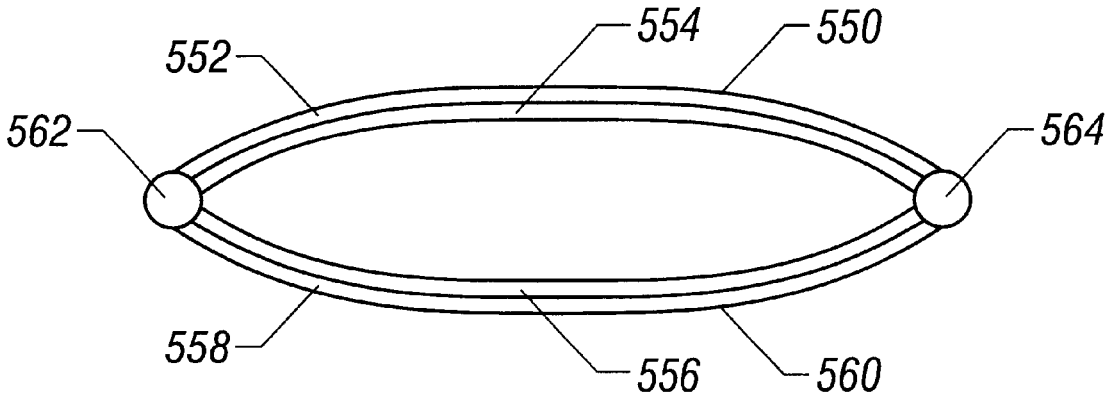

According to another embodiment, instead of using shape memory metal strips, bi-metallic strips can be used. As shown in FIGS. 12A–12B, a first bi-metallic strip 550 has two metal layers 552 and 554 having different coefficients of thermal expansion. At less than some predetermined temperature, the bimetallic strip 550 is generally flat (FIG. 12A). However, as the temperature increases, the two metal layers expand at different rates due to their different coefficients of thermal expansion. As a result, the bi-metallic strip 550 tends to curve outwardly (FIG. 12B).

As shown in FIGS. 12A–12B, two bi-metallic strips are used (strip 550 and strip 556). The strip 556 has two metal layers 558 and 560 that have different coefficients of thermal expansion. The strips 550, 556 are attached on their two ends to support rods 562 and 564, respectively. Thus, as temperature increases, the strips 550 and 556 bend away from each other, which causes the edges of the pouch to pull away from each other, thereby opening the pouch and exposing the enclosed desiccant module to the surrounding environment. Again in this embodiment, the temperature-activated mechanism includes an element that deforms to open the pouch 520.

In other embodiments, each of the strips 550 and 556 can be formed of non-metallic layers. Thus, each strip 550 and 556 has two or more non-metallic layers with different coefficients of thermal expansion to provide the bending effect in response to a temperature increase.

Various methods and apparatus have been described for protecting explosive components in various tools, such as tools for use in wellbores. For example, the tools may include perforating gun strings that contain sealed chambers in which corrosive gases (such as water vapor and other gases) or liquids may build up. This may occur in capsule shaped charges, sealed hollow carriers of guns, for example, or in adapters connecting guns. In each perforating gun, typical explosive components include shaped charges and detonating cords. In adapters, explosive components may include booster explosives, such as donor and receptor boosters. A buildup of corrosive gases may cause damage to or reduce the performance or reliability of the explosive components, which may result in a mis-fire. A hazard may also be caused by the presence of the corrosive gases, since certain components may be more susceptible to accidental detonation. For example, a detonating cord with its plastic wrapping damaged may be pinched, which may cause the detonating cord to initiate. An adsorptive material placed inside tools containing explosive components reduces the amount of corrosive gas build-up. In addition, by adsorbing water vapor and other gases, the rate of decomposition of explosives may be slowed, even at relatively high temperatures. This extends the stability of explosives.

Figure 7:
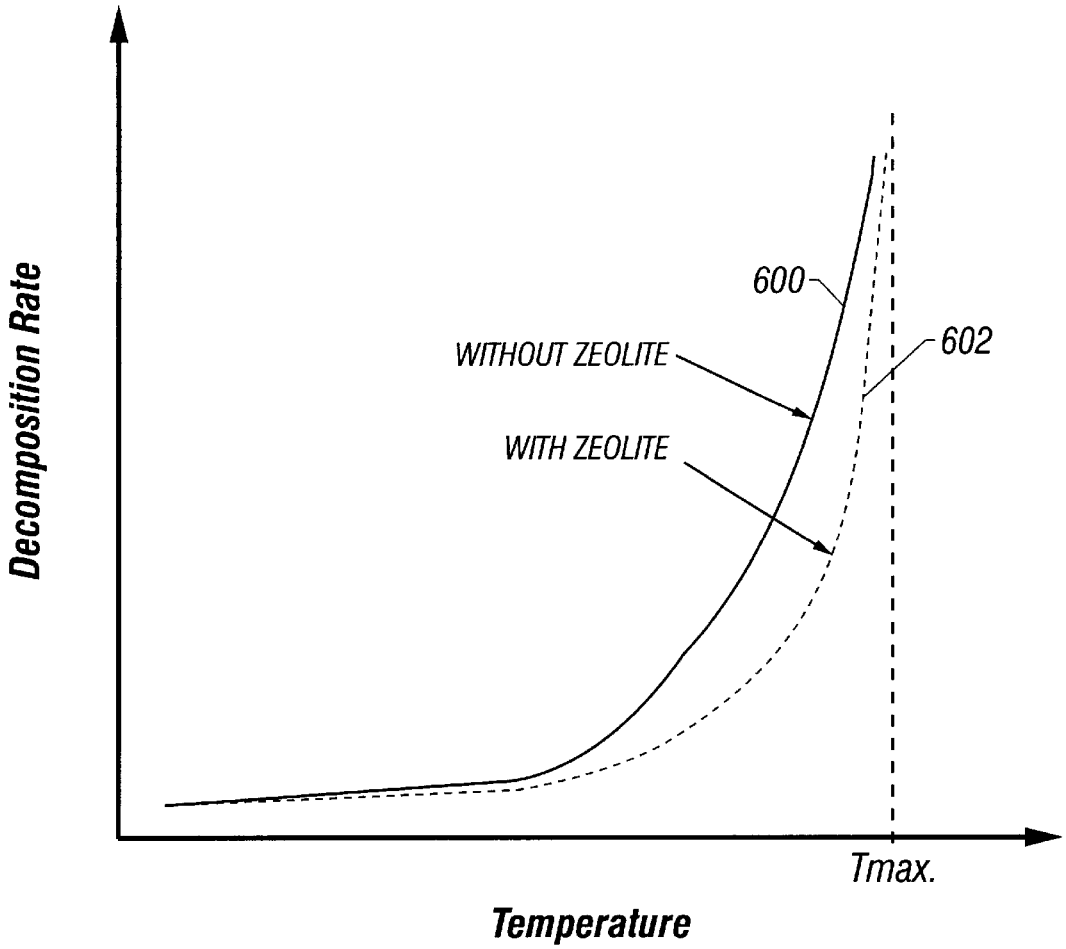
FIG. 7 illustrates graphs representing decomposition rates of an explosive with increasing temperature.

Referring to FIG. 7, graphs 600 and 602 illustrate a reduction in the decomposition rate if zeolite is used. The graph 600 represents the decomposition rate without zeolite as temperature increases. The graph 602 represents the decomposition rate with zeolite as temperature increases.

Other downhole tools that may contain explosives include firing heads, setting tools in which an explosive element is used for activation, disappearing plugs in which an explosive is used to shatter a plug, tools with propellants, and so forth.

Figure 10:
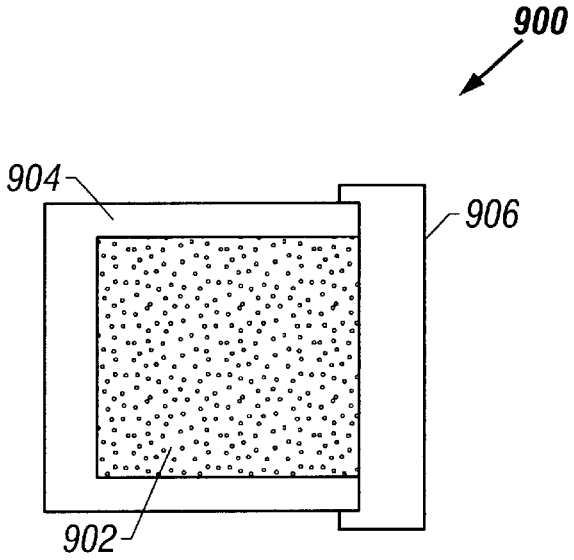
FIG. 10 illustrates a module having a container and an adsorptive material, with the container formed at least in part of a relatively low melting temperature material.

Referring to FIG. 10, a temperature-activated module 900 includes a container 904 containing an adsorptive material 902. A cap 906 is secured to the container 904 so that a hermetically sealed chamber is provided. The cap 906 is made of a relatively low melting temperature material that melts away at a predetermined temperature (such as downhole temperatures). In one embodiment, the cap may be formed of a eutectic material. An advantage of a eutectic material is that upon reaching its melting temperature, it turns into liquid form relatively quickly, avoiding a "mushy" state where a mixture of solid and liquid is present. Another advantage of a eutectic material is that a low melting temperature can be achieved.

In operation, to activate operation of the adsorptive material, the temperature of the module 900 is raised, such as by running it downhole, so that the cap 906 melts away and the adsorptive material is exposed to the atmosphere. The module 900 may be placed proximal an explosive. In an alternative embodiment, the whole container may be formed of the low melting temperature material.

Although reference has been made to tools for use in wellbores in the described embodiments, methods and apparatus according to further embodiments may be employed with surface tools. For example, such surface tools may include tools used in mining operations that may carry explosive components. Explosives may also be present in seismic tools, such as equipment used to generate seismic waves into the earth sub-surface for seismic acquisition. Other applications are also possible in further embodiments. Each of these tools, whether at the surface or downhole, includes an element to perform a predetermined operation, either at the surface or downhole.

While the invention has been disclosed with respect to a limited number of embodiments, those skilled in the art will appreciate numerous modifications and variations therefrom. It is intended that the appended claims cover all such modifications and variations as fall within the true spirit and scope of the invention.

What is claimed is:

1. An apparatus comprising:

a housing;

a component in the housing;

an adsorptive material placed in the housing and in the proximity of the component to adsorb a corrosive fluid; and a container containing the adsorptive material, the container having a temperature-activated opening mechanism to expose the adsorptive material.

2. The apparatus of claim 1, wherein the container is adapted to seal the adsorptive material in the container until opened.

3. The apparatus of claim 1, wherein the container is adapted to hermetically seal the adsorptive material in the container until opened.

4. The apparatus of claim 1, wherein the adsorptive material is adapted to remove a substantial amount of the corrosive fluid from within the housing.

5. The apparatus of claim 1, wherein the temperature-activated opening mechanism comprises an element formed of a shape memory metal.

6. The apparatus of claim 5, wherein the element is adapted to deform in response to a temperature rise to open the container.

7. The apparatus of claim 5, wherein the element comprises plural strips adapted to deform to open the container in response to a temperature rise.

8. The apparatus of claim 5, wherein the element comprises a first strip and a second strip, the first strip and second strip adapted to bend away from each other to open the container in response to a temperature rise of the element above a transformation temperature.

9. The apparatus of claim 8, wherein the first strip comprises a first shape memory metal strip and the second strip comprises a second shape memory metal strip.

10. The apparatus of claim 9, further comprising a support element attached to the first and second strips.

11. The apparatus of claim 10, wherein the support element comprises support rods.

12. The apparatus of claim 8, wherein the container has side walls, each of the strips located within a respective side wall.

13. The apparatus of claim 1, wherein the temperature-activated opening mechanism comprises an element formed of plural layers having different coefficients of thermal expansion.

14. The apparatus of claim 13, wherein the element is a bi-metallic element having plural metal layers with different coefficients of thermal expansion.

15. The apparatus of claim 14, wherein the element comprises two bi-metallic strips, each bi-metallic strip having the plural metal layers.

16. The apparatus of claim 15, wherein the two bi-metallic strips are adapted to bend away from each other to open the container in response to a temperature rise.

17. The apparatus of claim 13, wherein the element is adapted to deform in response to a temperature rise to open the container.

18. The apparatus of claim 1, wherein the adsorptive material is selected from the group consisting of alumina, activated charcoal, calcium-aluminosilicate, montmorillonite clay porcelain, silica gel, a molecular sieve, and a metalsilicate molecular sieve.

19. The apparatus of claim 1, wherein the adsorptive material comprises a molecular sieve.

20. The apparatus of claim 19, wherein the molecular sieve is based on at least one of organosilicate and organoaluminosilicate.

21. The apparatus of claim 1, wherein the adsorptive material comprises aluminophosphate.

22. The apparatus of claim 1, wherein the adsorptive material comprises a desiccant.

23. The apparatus of claim 1, wherein the adsorptive material comprises sodium aluminosilicate.

24. The apparatus of claim 1, wherein the adsorptive material comprises a zeolite.

25. The apparatus of claim 1, wherein the housing comprises a hollow gun carrier.

26. The apparatus of claim 1, wherein the housing comprises an adapter for connecting multiple guns, and wherein the component comprises one or more booster explosives.

27. The apparatus of claim 1, comprising a capsule shaped charge having the housing.

28. The apparatus of claim 1, wherein the component comprises an explosive.

29. A method of protecting a component in a high-temperature environment, comprising:

positioning an adsorptive material effective at a temperature greater than about 140° F. proximal the component to adsorb a corrosive fluid to protect the component;

providing a container to contain the adsorptive material; and providing a temperature-activated mechanism to open the container.

30. The method of claim 29, wherein positioning the adsorptive material comprises positioning the adsorptive material inside a housing containing the component.

31. The method of claim 29, wherein positioning the adsorptive material comprises positioning the adsorptive material proximal an explosive, the component comprising the explosive.

32. The method of claim 29, wherein positioning the adsorptive material comprises placing the adsorptive material in a container and positioning the container in a tool containing the component.

33. The method of claim 29, further comprising selecting an adsorptive material that is effective at a temperature greater than about 200° F.

34. The method of claim 29, wherein providing the temperature-activated mechanism comprises providing an element formed of a shape memory metal.

35. The method of claim 34, further comprising opening the container in response to a temperature rise above a predetermined threshold.

36. The method of claim 34, wherein providing the element comprises providing plural strips each formed of the shape memory metal.

37. The method of claim 36, further comprising opening the container with the temperature-activated mechanism, wherein the plural strips deform to open the container in response to a temperature rising above a predetermined threshold.

38. The method of claim 29, wherein providing the temperature-activated mechanism comprises providing an element having plural layers with different coefficients of thermal expansion.

39. The method of claim 38, wherein providing the element comprises providing a strip having the plural layers.

40. The method of claim 39, wherein providing the strip having plural layers comprises providing the strip having plural metal layers.

41. The method of claim 39, wherein providing the element further comprises providing a second strip having plural layers with different coefficients of thermal expansion.

42. The method of claim 41, further comprising opening the container using the temperature-activated mechanism in response to a rise in temperature, wherein the first and second strips deform to open the container in response to the temperature rise.

43. A tool comprising:

an element to perform a predetermined operation;

an explosive;

an adsorptive material placed proximal the explosive; and a container containing the adsorptive material, the container having a temperature-activated mechanism adapted to open the container.

44. The tool of claim 43, wherein the container is adapted to seal the adsorptive material until opened.

45. The tool of claim 43, wherein the container is adapted to hermetically seal the adsorptive material until opened.

46. The tool of claim 43, wherein the temperature-activated mechanism has an element formed of a shape memory metal.

47. The tool of claim 46, wherein the element is adapted to deform to open the container in response to a temperature rise.

48. The tool of claim 43, wherein the temperature-activated mechanism has an element formed of plural layers with different coefficients of thermal expansion.

49. The tool of claim 48, wherein the element comprises a bi-metallic element.

50. A container for positioning proximal a component in a tool, comprising:

a sealed housing;

an adsorptive material in the sealed housing; and a temperature-activated opening mechanism to unseal the housing to expose the adsorptive material to an environment surrounding the component.

51. The container of claim 50, wherein the temperature-activated mechanism comprises an element formed of a shape memory metal.

52. The container of claim 50, wherein the temperature-activated mechanism comprises a bi-metallic element.

* * * * *